US007108351B2

(12) United States Patent
Izawa et al.

(10) Patent No.: US 7,108,351 B2
(45) Date of Patent: Sep. 19, 2006

(54) INK JET RECORDING APPARATUS

(75) Inventors: Hideo Izawa, Chiba (JP); Akira Ishikawa, Chiba (JP); Yuuichi Yamazaki, Chiba (JP)

(73) Assignee: Miyakoshi Printing Machinery Co., Chiba (JP)

( * ) Notice: Subject to any disclaimer, the term of this patent is extended or adjusted under 35 U.S.C. 154(b) by 238 days.

(21) Appl. No.: 10/700,867

(22) Filed: Nov. 4, 2003

(65) Prior Publication Data

US 2005/0012774 A1 Jan. 20, 2005

(30) Foreign Application Priority Data

Jul. 17, 2003 (JP) ..... 2003-275985

(51) Int. Cl.
*B41J 2/145* (2006.01)
*B41J 2/01* (2006.01)

(52) U.S. Cl. ..... 347/40; 347/104; 347/105

(58) Field of Classification Search ..... 347/40, 347/37, 16, 101, 104, 105, 154; 346/136, 346/139; 400/621
See application file for complete search history.

(56) References Cited

U.S. PATENT DOCUMENTS 5,376,957 A 12/1994 Gandy et al.
5,828,814 A 10/1998 Cyman et al.
6,003,988 A 12/1999 McCann et al.
6,309,046 B1 * 10/2001 Izawa et al. ..... 347/40
2002/0090244 A1 7/2002 Wood et al.
2002/0105571 A1 8/2002 Izawa et al.

FOREIGN PATENT DOCUMENTS

JP 05-124284 5/1993
JP 11-034360 2/1999
JP 2000-141618 5/2000

* cited by examiner

*Primary Examiner*—Shih-wen Hsieh
(74) *Attorney, Agent, or Firm*—Cohen, Pontani, Lieberman & Pavane

(57) ABSTRACT

In order to allow the use of an ink jet printing head of drop-on-demand type and with an ink nozzle assembly having a predetermined length in a direction of travel of a paper web to perform high precision and high speed printing, the ink jet printing head (2) is disposed relative to the traveling paper web (4) at a position such that the nozzle assembly (2*a*) lies opposed to a linearly traveling surface area of paper web that is leaving from a guide roller (3) immediately after the traveling paper web has had its wrapping contact with the same or a linearly traveling surface area of paper web that is approaching a guide roller (3) immediately before the traveling paper web has its wrapping contact with the same. The nozzle assembly (2*a*) of the ink jet printing head (2) has its upstream end positioned to coincide in position with a paper wrap end point lying at a downstream end of a paper wrap region in which the paper web (4) is wrapped on the guide roller (3) or has its downstream end positioned to coincide in position with a paper wrap start point lying at a upstream end of a paper wrap region in which the paper web (4) is wrapped on the guide roller (3).

5 Claims, 2 Drawing Sheets

INK JET RECORDING APPARATUS

BACKGROUND OF THE INVENTION

1. Field of the Invention

The present invention relates to an ink jet recording apparatus using an ink jet printing head to perform printing a paper web with jets of ink and, in particular, an ink jet printing head of drop-on-demand type having a nozzle assembly which comprises a plurality of nozzle rows juxtaposed with one another in a direction of travel of the paper web to give the nozzle assembly a predetermined length in the direction of travel of the paper web, each of the nozzle rows having a multitude of ink nozzles juxtaposed with one another in a direction of width of the paper web.

2. Description of the Prior Art

In an ink jet recording apparatus, it is an important requisite in providing good printing quality that the spacing between an ink jet printing head and the surface of a paper web (printing surface) be held constant. When use is made of an ink jet printing head which as in an ink jet recording apparatus as described, e. g., in U.S. Pat. No. 6,003,988, has a nozzle assembly made of only a single nozzle row having ink nozzles juxtaposed with one another in a direction perpendicular to a direction of travel of the paper web, namely in a direction of width of the paper web, the curving of a paper web traveling path with the paper web wrapped on a roller surface does not hinder printing on the paper web. However, when use is made of an ink jet printing head of drop-on-demand type which as in an ink jet recording apparatus as described, e. g., in JP H11-034360 A, has a nozzle assembly made of a plurality of nozzle rows juxtaposed with one another in a direction of travel of a paper web, the ink discharge ports in these nozzle rows arranged in the direction of travel of paper must have their front ends arranged in a plane whereby if the paper web traveling path is curved with the paper web wrapped on a roller surface, a change may be created in distance between the front ends of the ink nozzles (ink discharge ports) and the paper surface along the direction of travel of the paper web. If this occurs, printing problems such as a printed image being out of register and a distorted print image are significantly brought about. Thus, a nozzle head with a nozzle assembly having a predetermined length in a direction of travel of a paper web gives rise to such printing problems.

There is also known as disclosed in JP H05-124284 A an ink jet recording apparatus in which a plate-like guide member is disposed below a paper web traveling path between a plurality of rollers so that a paper web is urged against the guide member and a single ink jet printing head is disposed opposite and parallel to the surface of the paper web. Further, as disclosed in JP 2000-141618 an ink jet recording apparatus is known in which a plurality of ink jet printing heads are arranged each opposite and parallel to a surface of paper web between rollers on which the paper web is wrapped while having a tension applied to it.

In an apparatus of this type having a single ink jet printing head or a plurality of ink jet printing heads which is or are each disposed parallel to the paper surface between the guide rollers, the or each ink jet printing head may be an ink jet heat of drop-on-demand type and with a nozzle assembly having a plurality of nozzle rows juxtaposed with one another in a direction of travel of the paper web to be able generally to perform printing without adverse influence from a paper wrap angle for a guide roller because it is placed opposite and parallel to the paper surface between the rollers. However, in the ink jet recording apparatus of this type, if the rollers guiding paper while wrapping it on them are spaced from each other by a long distance, it is no longer possible to completely eliminate fluttering of the paper web traveling between the guide rollers. Fluttering of the paper web may occur between the rollers while it is driven to travel at a high speed or when the speed changes. Then, the result may be a disorder created in a printed image or a failure to print with due accuracy.

BRIEF SUMMARY OF THE INVENTION

Made to solve the problems mentioned above, the present invention has for its object to provide an ink jet recording apparatus which is cable of printing a paper web in a state free from paper traveling fluttering irrespective of short and long distance between rollers so that an accurate printing can be performed by an ink jet head with a nozzle assembly having a plurality of nozzle rows juxtaposed with one another in a direction of travel of the paper web.

In order to achieve the object mentioned above, there is provided in accordance with the present invention an ink jet recording apparatus having an ink jet printing head for printing a paper web guided to travel in an arc configuration on a plurality of guide rollers while having a predetermined tension applied thereto, which apparatus characterized in that the said ink jet printing head is constituted by an ink jet printing head of drop-on-demand type and with a nozzle assembly comprising a plurality of nozzle rows juxtaposed with one another in a direction of travel of the paper web and within a predetermined distance; and the ink jet printing head is disposed relative to the traveling paper web at a position such that the nozzle assembly lies opposed to a linearly traveling surface area of paper web that is leaving the guide roller immediately after the traveling paper web has had its wrapping contact with the same or that is approaching the guide roller immediately before the traveling paper web has its wrapping contact with the same. Further, the nozzle assembly of the ink jet printing head has its upstream end positioned to coincide in position with a paper wrap end point lying at a downstream end of a paper wrap region in which the paper web is wrapped on the guide roller, or has its downstream end positioned to coincide in position with a paper wrap start point lying at a upstream end of a paper wrap region in which the paper web is wrapped on the guide roller.

According to the present invention, an ink jet recording apparatus of drop-on-demand type and with a nozzle assembly having a plurality of nozzle rows juxtaposed with one another in a direction of travel of a paper web is allowed to print the paper web on a surface area of paper that is leaving the guide roller immediately after the traveling paper web has had its wrapping contact with the same or that is approaching the guide roller immediately before the traveling paper web has its wrapping contact with the same, namely in an area where the possibility of the traveling paper web to flutter is at a minimum. As a result, an improved printing accuracy during high speed printing is ensured.

BRIEF DESCRIPTION OF THE DRAWINGS

These and other objects, features and advantages of the present invention as well as other manners of its implementation will become more readily apparent, and the invention itself will also be better understood, from the following detailed description when taken with reference to the drawings attached hereto showing certain illustrative forms of implementation of the present invention. In the drawings.

DETAILED DESCRIPTION

Figure 1:
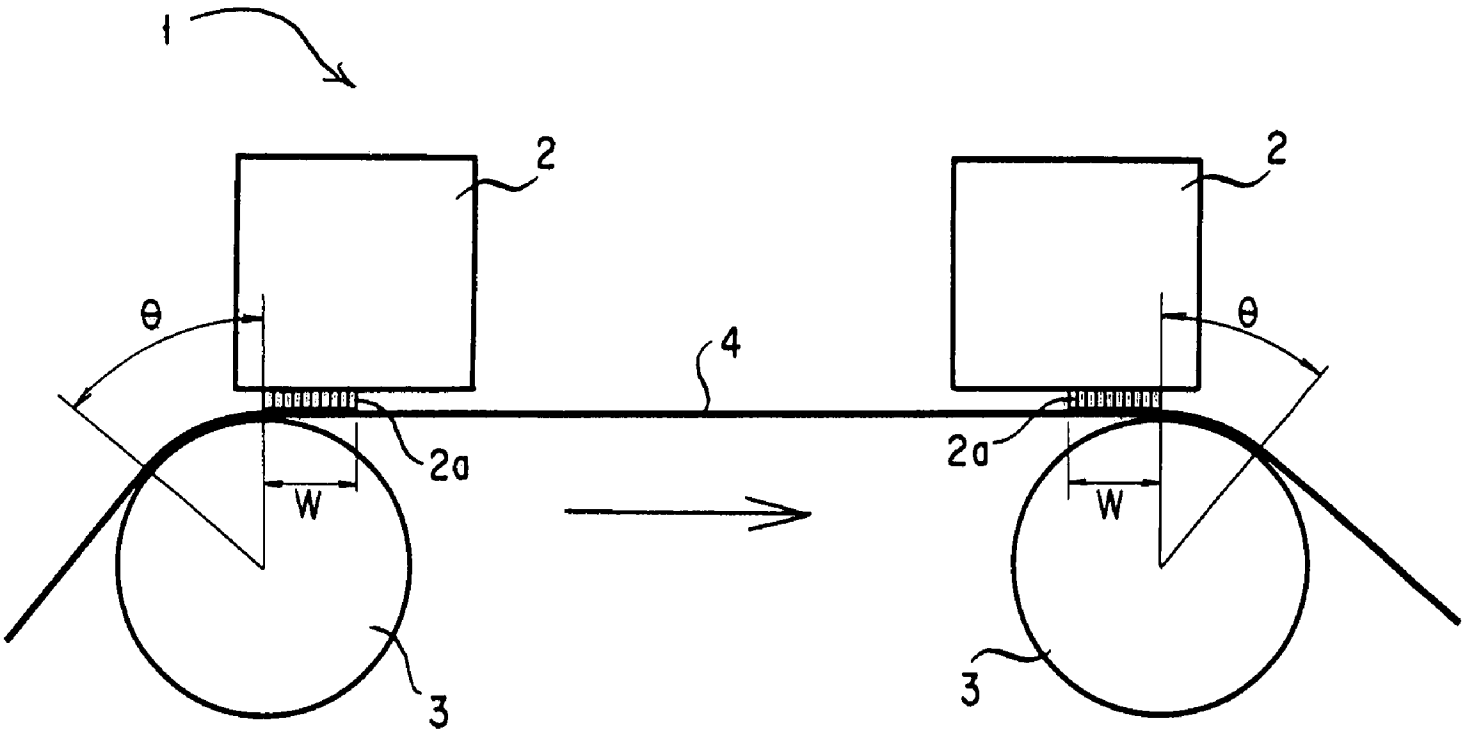
FIG. 1 is a diagrammatic makeup explanatory view illustrating a first form of implementation of the present invention.

In FIG. 1 there is shown an ink jet recording apparatus 1 comprising a plurality of (e. g., two as shown) ink jet printing heads 2, 2 and a plurality of (e. g., two as shown) guide rollers 3. and 3 on which a paper web 4 is wrapped in an arc configuration while having a predetermined tension applied thereto. The guide rollers 3 and 3 are spaced apart from each other by a predetermined distance across a printing region in which prints in the same number as the number of the ink jet printing heads 2 are made on a surface of the paper web 4. Each of the ink jet printing heads 2 here is constituted by an ink jet printing head of drop-on-demand type and with a nozzle assembly 2*a* having a length W in a direction of travel of the paper web 4. The nozzle assembly 2*a* has a plurality of nozzle rows juxtaposed with one another in a direction in which the paper web 4 travels, each of the nozzle rows having a multiplicity of ink nozzles juxtaposed with one another in a direction of width of the paper web 4. Here, the paper web 4 travels in the direction indicated by the arrow.

The paper web 4 is wrapped on the guide rollers 3 and 3 at a wrap angle θ in their respective inlet and outlet paper wrap regions. Upstream of the inlet paper wrap region or the inlet guide roller 3 the paper web 4 is guided by an upstream guide roller (not shown) and the inlet guide roller 3 to travel linearly between them. Downstream of the outlet paper wrap region or the outlet guide roller 3 the paper web 4 is guided by the outlet guide roller 3 and a downstream guide roller (not shown) to travel linearly between them. The nozzle assembly 2*a* of one of the ink jet printing heads or the inlet ink jet printing head 2 has its upstream end positioned to coincide in position with an inlet paper wrap end point lying at a downstream end of the inlet paper wrap region in which the paper web 4 is wrapped on the inlet guide roller 3 at a wrap angle θ. The nozzle assembly 2*a* of the other ink jet printing head or the outlet ink jet printing head 2 has its downstream end positioned to coincide in position with an outlet paper wrap start point lying at an upstream end of the outlet paper wrap region in which the paper web 4 is wrapped on the outlet guide roller 3 at a wrap angle θ. A predetermined tension is applied to the paper web 4 between the upstream and downstream guide rollers to allow the paper web 4 to travel linearly in the printing region between the inlet and outlet guide rollers 3 and 3 in which each of the respective nozzle assemblies 2*a* in the ink jet printing heads 2 and 2 is positioned opposite and parallel to and spaced apart with a predetermined distance to the linearly traveling paper web 4.

According to the apparatus makeup mentioned above, the paper web 4 guided by a plurality of guide rollers 3 in an arc configuration while having a predetermined tension applied thereto is printed by a plurality of ink jet printing heads on an area thereof immediately after or before its wrapping contact with a said guide roller 3, namely on a surface area that is leaving the inlet guide roller 3 immediately after it has had its wrapping contact with the same and on a surface area that is approaching the outlet guide roller 3 immediately before it has its wrapping contact with the same as shown. Thus, each print is made by each ink jet printing head 2 in such a surface area of the paper web 4 in a printing region that its binding force is strong due to its wrapping by a corresponding guide roller 3, namely in a surface area where the possibility of the traveling paper to flutter is at a minimum. As a result, an improved printing accuracy during high speed printing is ensured.

Figure 2:
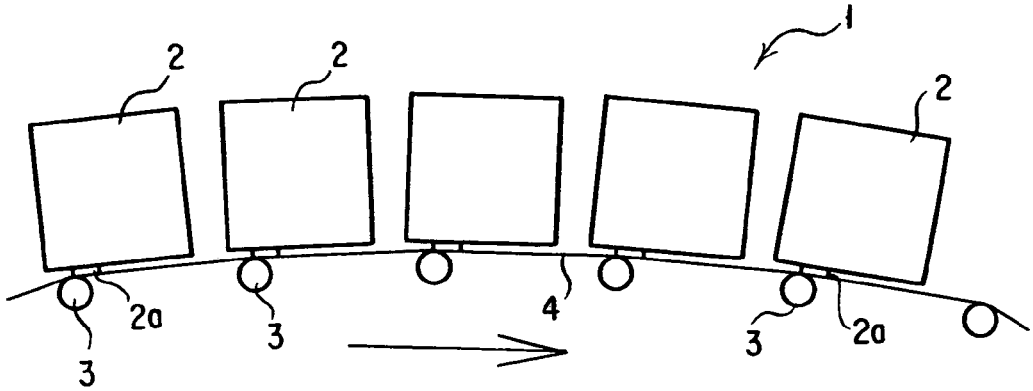
FIG. 2 is a diagrammatic makeup explanatory view illustrating a second form of implementation of the present invention.
Figure 3:
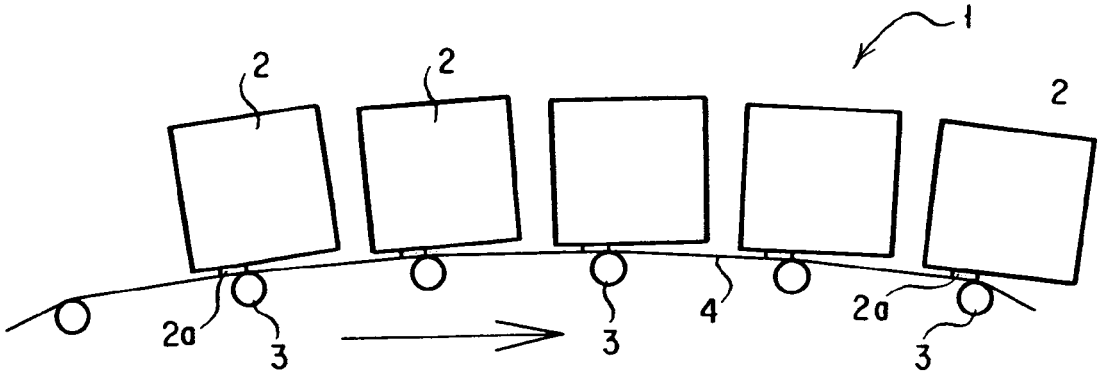
FIG. 3 is a diagrammatic makeup explanatory view illustrating a third form of implementation of the present invention.
Figure 4:
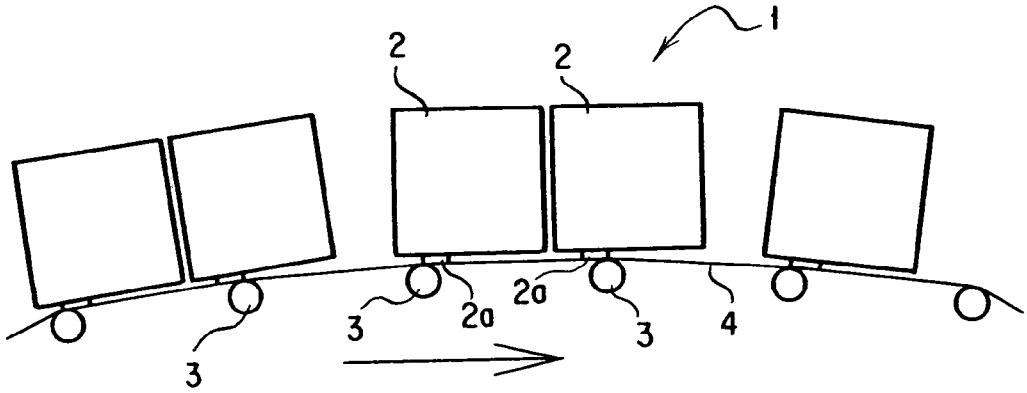
FIG. 4 is a diagrammatic makeup explanatory view illustrating a fourth form of implementation of the present invention

FIGS. 2, 3 and 4 show examples of how a plurality of (three or more) ink jet printing heads 2, 2, . . . may be arranged for printing a paper web 4 traveling while wrapping on a plurality of (three or more) guide rollers 3, 3, . . . The example shown in FIG. 2 indicates that every ink jet printing head 2 has its nozzle assembly 2*a* arranged at the downstream side of its corresponding guide roller 3, namely that the nozzle assembly 2*a* of every ink jet nozzle 2 has its upstream end positioned to coincide in position with a paper wrap end point lying at a downstream end of the paper wrap region on the guide roller 3.

The example shown in FIG. 3 indicates that every ink jet printing head 2 has its nozzle assembly 2*a* arranged at the upstream side of its corresponding guide roller 3, namely that the nozzle assembly 2*a* of every ink jet printing head 2 has its downstream end positioned to coincide in position with a paper wrap start point lying at an upstream end of the paper wrap region on the guide roller 3.

The example shown in FIG. 4 indicates an example similar to that shown in FIG. 1 in which two adjacent ink jet printing heads 2 and 2 have their nozzle assemblies 2*a* and 2*a* arranged in the inside of or between two adjacent guide rollers 3 and 3, namely in which the nozzle assembly 2*a* of the ink jet printing head 2 on the upstream side has its upstream end positioned to coincide in position with a paper wrap end point lying at a downstream end of the paper wrap region on the guide roller 3 on the upstream side while the nozzle assembly 2*a* of the ink jet printing head 2 on the downstream side has its downstream end positioned to coincide in position with a paper wrap start point lying at an upstream end of the paper wrap region on the guide roller 3 on the downstream side.

Although not shown in these examples, it will readily be appreciated by those skilled in the art that on the upstream side of the upstream-most guide roller 3 shown and/or on the downstream side of the downstream-most guide roller 3 shown there may be an additional ink jet printing head 2 having a nozzle assembly 2*a* such that it has its downstream end positioned to coincide in position with a paper wrap start point lying at an upstream end of the paper wrap region on that guide roller 3 and/or an additional ink jet printing head 2 having a nozzle assembly 2*a* such that it has its upstream end positioned to coincide in position with a paper wrap end point lying at a downstream end of the paper wrap region on that guide roller 3.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences of scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

The invention claimed is:

1. An ink jet recording apparatus for printing a paper web guided to travel in an arc configuration on a plurality of guide rollers while having a predetermined tension applied thereto, comprising:

an ink jet printing head of a drop-on-demand type with a nozzle assembly comprising a plurality of nozzle rows juxtaposed with one another in a direction of travel of the paper web and within a predetermined distance;

wherein said ink jet printing head is adapted to be disposed relative to the traveling paper web at a position such that said nozzle assembly lies opposed to a linearly traveling surface area of the paper web that is leaving a first of said guide rollers immediately after the traveling paper web ends its wrapping contact with said first guide roller or that is approaching a second of said guide roller immediately before the traveling paper web begins its wrapping contact with said second guide roller; and wherein the nozzle assembly of said ink jet printing head has its upstream end positioned to coincide in position with a paper wrap end point lying at a downstream end of a paper wrap region in which the paper web is wrapped on said first guide roller.

2. The ink jet recording apparatus of claim 1, further comprising a plurality of said ink jet printing heads along with a plurality of said guide rollers.

3. An ink jet recording apparatus for printing a paper web guided to travel in an arc configuration on a plurality of guide rollers while having a predetermined tension applied thereto, comprising:

an ink jet printing head of a drop-on-demand type with a nozzle assembly comprising a plurality of nozzle rows juxtaposed with one another in a direction of travel of the paper web and within a predetermined distance;

wherein said ink jet printing head is adapted to be disposed relative to the traveling paper web at a position such that said nozzle assembly lies opposed to a linearly traveling surface area of the paper web that is leaving a first of said guide rollers immediately after the traveling paper web ends its wrapping contact with said first guide roller or that is approaching a second of said guide roller immediately before the traveling paper web begins its wrapping contact with said second guide roller; and wherein the nozzle assembly of said ink jet printing head has its downstream end positioned to coincide in position with a paper wrap start point lying at an upstream end of a paper wrap region in which the paper web is wrapped on said second guide roller.

4. The ink jet according apparatus of claim 3, further comprising a plurality of said ink jet printing heads along with a plurality of said guide rollers.

5. An ink jet recording apparatus for printing a paper web guided to travel in an arc configuration on a plurality of guide rollers while having a predetermined tension applied thereto, comprising:

an ink jet printing head of a drop-on-demand type with a nozzle assembly comprising a plurality of nozzle rows juxtaposed with one another in a direction of travel of the paper web and within a predetermined distance;

wherein said ink jet printing head is adapted to be disposed relative to the traveling paper web at a position such that said nozzle assembly lies opposed to a linearly traveling surface area of the paper web that is leaving a first of said guide rollers immediately after the traveling paper web ends its wrapping contact with said first guide roller or that is approaching a second of said guide roller immediately before the traveling paper web begins its wrapping contact with said second guide roller; and a plurality of said ink jet printing heads along with a plurality of said guide rollers, wherein the nozzle assembly of at least one of said ink jet printing heads has its downstream end positioned to coincide in position with a paper wrap start point lying at an upstream end of a paper wrap region in which the paper web is wrapped on its corresponding guide roller while the nozzle assemblies of the others of said plurality of ink jet printing heads have their respective upstream ends positioned to coincide in position with paper wrap end points lying at downstream ends of paper wrap regions in which the paper web is wrapped on their corresponding guide rollers, respectively.

* * * * *